United States Patent [19]

Bozzio

[11] Patent Number: 4,648,302

[45] Date of Patent: Mar. 10, 1987

[54] ELECTRONIC DRUM RIM

[76] Inventor: Terry Bozzio, 449 S. Beverly Dr., Ste. 102, Beverly Hills, Calif. 90212

[21] Appl. No.: 750,306

[22] Filed: Jul. 1, 1985

[51] Int. Cl.[4] ..... G10H 3/12

[52] U.S. Cl. ..... 84/1.04; 84/1.06; 84/DIG. 12

[58] Field of Search ..... 84/1.04, 1.06, 1.14, 84/DIG. 12

[56] References Cited

U.S. PATENT DOCUMENTS 4,479,412 10/1984 Klynas ..... 84/1.04

OTHER PUBLICATIONS

Dynacord Duopad, D-8440 Straubling, (W. Germany), Postfach 0254, Telefon (09421) 3101, Telex 65520, published on or before Apr. 19, 1985.

*Primary Examiner*—Stanley J. Witkowski

*Attorney, Agent, or Firm*—Spensley Horn Jubas & Lubitz

[57] ABSTRACT

An auxiliary electronic sound source for an electronic drum. The auxiliary sound source is attached to a conventional electronic drum and enables a drummer to practice acoustical "sticking" techniques involving a drum rim. The auxiliary sound source includes a striking element with an acoustically isolating connection to the electronic drum. A piezoelectric material transducer is attached to the striking element to convert impact induced vibrations in the striking element into an electrical output signal. In an alternative embodiment, the piezoelectric transducer is attached to a mounting plate detachably connected to the striking element.

22 Claims, 3 Drawing Figures

ELECTRONIC DRUM RIM

BACKGROUND OF THE INVENTION

1. Field of the Invention

The present invention concerns electronic musical instruments, and more particularly electronic drums.

2. Description of the Prior Art

Electronic musical instruments are becoming increasingly popular with modern musical groups. Such instruments typically translate a vibration in an element manipulated by a performer into an electrical output signal which can then be processed by diverse methods. Electronic instruments generally offer a wide variety of musical tones through electronic processing with substantial versatility in individual instruments.

Electronic drums are one type of electronic musical instrument in which a performer typically hits a striking element with a drumstick to produce a vibration in the striking element which is subsequently translated into an electrical output signal. Through electronic processing, some electronic drums can be used to simulate virtually any type of percussion instrument.

A number of electronic drums have been developed in the past. Most of these electronic drums, however, do not permit a drummer to use conventional acoustical "sticking" techniques. These techniques include among others: rim shots (simultaneously striking a drum head and rim), side stick (laying a drumstick tip on the drum head and tapping the rim), and stick-on-rim (striking the drum rim alone). With an electronic drum providing only one electrical output signal, for example, only one tone is produced regardless of where the drummer strikes the drum. Electronic drums producing a single output signal suffer from a further disadvantage in that a large amount of space may be occupied in providing a sufficient number of drums for all of the tones a drummer may wish to produce, especially during a live performance. This tends to disadvantageously obscure the drummer from the view of an audience.

Consequently, there presently exists a need for a device to permit drummers to use acoustical "sticking" techniques on existing electronic drums and also provide additional electronic output signal sources.

SUMMARY OF THE INVENTION

It is therefore an object of the present invention to provide additional electronic sound sources for use on both existing electronic drums and conventional (nonelectronic) drums. It is a further object of the present invention to provide additional electronic sound sources which facilitate a drummer's use of conventional acoustical "sticking" techniques.

These and other goals and objectives are accomplished in the present invention by providing additional striking elements and electronic signal sources which are attached to an existing electronic or acoustical drum. These additional striking elements are disposed about the general rim or edge of an existing electronic or acoustical drum and are acoustically isolated from the drum. In one embodiment of the present invention, a transducer, converting impact-induced vibrations into an electrical output signal, is attached directly to the striking element. In an alternative embodiment, the transducer is attached to a plate detachably connected to the striking element to facilitate swift replacement if the transducer fails.

The novel features which are believed to be characteristic of the present invention, together with further objectives and advantages thereof, will be better understood from the following detailed description considered in connection with the accompanying drawings. It should be expressly understood, however, that the drawings are for purposes of illustration and description only and are not intended as a definition of the limits of the invention.

BRIEF DESCRIPTION OF THE DRAWINGS

Like reference numbers in the drawings refer to like elements.

DETAILED DESCRIPTION

Figure 1:
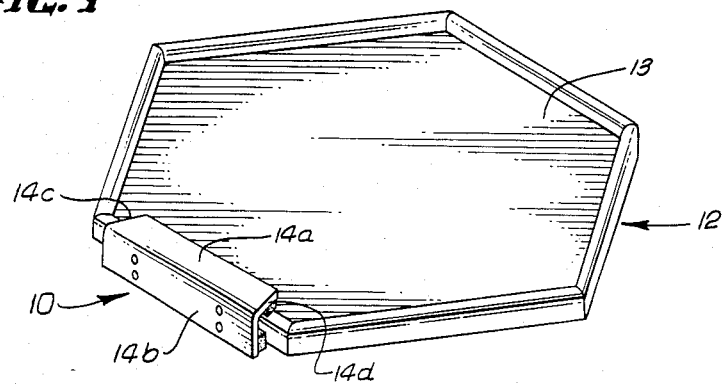
FIG. 1 is a perspective view of one embodiment of the present inventive electronic sound source attached to the rim portion of an existing electronic drum.

Referring to the figures, and more particularly FIG. 1, there is shown one embodiment of the present inventive electronic sound source, generally designated 10, attached to an exemplary drum 12. The drum 12 may be any of a number of electronic or conventional acoustical drums. While shown having a generally flat hexagonal shape, the drum 12 may have any general shape and may be provided with one or more striking surfaces 13.

Figure 2:
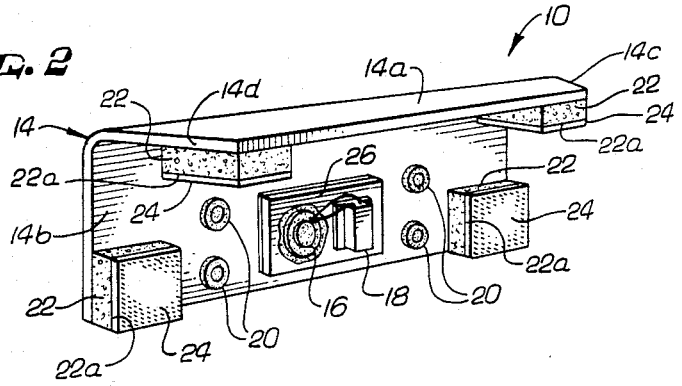
FIG. 2 is a perspective view of a preferred embodiment of the present inventive electronic sound source.

As shown in FIG. 2, the present inventive electronic sound source 10 includes a striking element, or rim, 14 and a transducer 16 for converting impact induced vibrations in the rim 14 into an an electrical output signal. An electrical connector 18 may also be included to provide a quick disconnect interface between the transducer 16 and wires (not shown) leading to some appropriate type of electrical signal processing equipment.

In the illustrated embodiment, the rim 14 is a unitary structure having two portions 14*a,b* oriented at an approximate right angle and joined together in a smooth continuous curve. The use of a smooth continuous merger between the two rim portions 14*a,b* avoids the possible creation of an acoustical "dead zone" encountered along a sharp-edged merger. However, in some instances, a sharp-edged merger may prove acoustically satisfactory. If desired, the upper edges 14*c*, 14*d* of the rim 14 may be slanted inward to permit attachment of two electronic sound sources 10 to adjacent edges of a polygonally shaped drum 12. The rim 14 can be composed of several different materials. Rims 14 having satisfactory acoustical characteristics and durability may be constructed from aluminum, nylon, and LEXAN or similar materials. (As is well known in the art, LEXAN is a trademarked thermoplastic polycarbonate condensation product of bisphenol-A and phosgene, while nylon is a generic term for a long-chain synthetic polymeric amide).

The rim 14 can be attached to the drum 12 by a number of different methods. This connection, however, should be sufficiently acoustically isolating such that vibrations in the rim 14 are not picked up by a vibration sensor within an electronic type drum 12 and such that vibrations in the striking surface 13 of either an electronic or acoustical type drum 12 are not picked up by the transducer 16. One such acoustically isolating connection is achieved by providing a plurality of holes in one rim portion 14*a* or 14*b* within which resiliently deformable, or rubber-like, grommets 20 are disposed. Screws can then be threaded into the side or upper surface of the drum 12 with the projecting ends of the screws inserted into the grommets 20. Alternatively, an acoustically isolating connection can be achieved by adhesively bonding pairs of resiliently deformable or compressible foam plastic or rubber-like elements 22 to opposing inner surfaces of the rim portions 14*a,b*. Detachable fasteners such as VELCRO pads 24 (VELCRO is a registered trademark for fibrous detachable fasteners) can then be bonded to the exposed surfaces 22*a* of the foam plastic elements 22 with complementary type VELCRO pads bonded to the edge and upper surface of the drum 12. Various types of re-attachable adhesives could be used in place of the VELCRO.

A satisfactory conversion of impact induced vibrations in the rim 14 into electrical output signals is achieved by using transducers 16 incorporating a piezoelectric material. Piezoelectric transducers are well known in the art and are available from a number of sources, such as, for example, Kyocera International, Inc. of San Diego, Calif. The transducer 16 can be mounted to either the interior or exterior surface of either rim portion 14*a* or 14*b*. In the illustrated embodiment, the transducer 16 is mounted on an inner surface of the rim portions 14*b* to avoid general visibility of the tranducer 16 for aesthetic purposes.

Wires leading from the transducer 16 may be attached to a conventional electrical quick disconnect type connector 18. This provides a convenient connection between the transducer 16 and an electronic system used for processing the electrical output signal produced by the transducer 16. Such quick disconnect type connectors are well known in the art and are widely commercially available. Alternatively, the wires leading from the transducer 16 may be attached to a conventional electrical output jack (not shown) which could be detachably mounted onto the underside of the electronic drum 12.

The transducer 16 and electrical connector 18 may both be mounted on the rim 14 or, alternatively, mounted on a plate 26 removably attached to the rim 14. By using a detachable plate 26, both the transducer 16 and an electrical connector 18 can be quickly and easily removed from the rim 14 if either the transducer 16 fails or the rim 14 fractures. The detachable plate 26 may be removably attached to the rim 14 by any number of convenient methods. In the illustrated embodiment, complementary types of VELCRO are respectively bonded to the rim 14 and the detachable plate 26. Using a VELCRO material also provides some additional shock mounting for the transducer 16.

Figure 3:
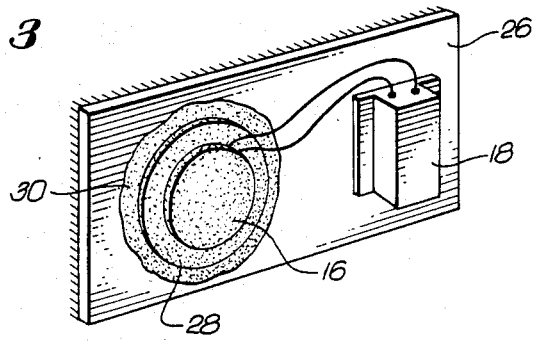
FIG. 3 is a perspective view detailing the attachment method for the transducer of the present invention.

FIG. 3 shows the manner in which the transducer 16 is attached to either the rim 14 or detachable plate 26. A slightly resilient element 28 is first adhesively bonded to either the rim 14 or detachable plate 26 with an adhesive having a rubbery character when cured. Such adhesives are well known in the art, one example being a room temperature vulcanizing adhesive. The element 28 may be composed of a number of slightly resilient materials such as, for example, LEXAN. The transducer 16 is then bonded to the resilient element 28 with the same type of adhesive used in securing the resilient element 28. The entire transducer 16 is then encapsulated in a coating 30 of this adhesive. It has been found that bonding the transducer 16 to the rim 14 or detachable plate 26 with a resilient element 28 is useful to partially shield the transducer 16 from vibrational shock and structural flexing encountered when the rim 14 is struck during playing. Use of a rubbery adhesive provides further shock attenuation. The adhesive coating 30 encapsulating the transducer 16 protects the wires extending from the transducer 16 from dislodging due to playing shocks.

In operation, the rim 14 is attached to the edge of an existing electronic or acoustical type drum 12 with additional electrical output signals provided by the transducers 16 via the connector 18 or a conventional output jack. The drummer can then use the rim 14 for conventional acoustical "sticking" techniques when playing the drum 12. For example, rim shots can be accomplished by hitting the rim 14 and the drum striking surface 13 simultaneously. Alternatively, the drummer may simply utilize the rims 14 as additional percussion type electronic sound sources.

It will, of course, be understood that modifications of the present inventive electronic drum rim and its various aspects will be apparent to those skilled in the art, some being apparent only after study and others being merely matters of routine mechanical design. For example, the rim 14 need have only one portion 14*a* or 14*b* rather than both as shown in the illustrated embodiment. Consequently, the scope of the present invention should be be limited by the particular embodiments described herein, but should be defined only by the appended claims and equivalents thereof.

What is claimed is:

1. An electronic sound source for use at a rim portion of a drum, comprising a striking element;

attachment means, connected to said striking element, for attaching said striking element to said rim portion, said attachment means including acoustic isolating means for providing an acoustically isolating connection between the striking element and the drum; and transducer means, acoustically coupled to the striking element, for converting impact induced vibrations in the striking element into an electrical output signal.

2. The electronic sound source of claim 1 further comprising a resilient element interposed between the striking element and the transducer means for partially shielding the transducer means from vibrational shock induced in the striking element when the striking element is impacted.

3. The electronic sound source of claim 1 wherein said striking element is a unitary structure having a first and a second portion joined at an approximate right angle in a continuous curve.

4. The electronic sound source of claim 3 wherein said striking element is composed of aluminum.

5. The electronic sound source of claim 3 wherein said striking element is composed of a long chain synthetic polymeric amide.

6. The electronic sound source of claim 1 wherein the striking element has a plurality of holes defined therein and the acoustic isolating means comprises a plurality of resiliently deformable grommets respectively disposed in the striking element holes.

7. The electronic sound source of claim 1 wherein the acoustic isolating means comprises a plurality of resiliently deformable elements interposed between the striking element and the drum.

8. The electronic sound source of claim 1 wherein said transducer means is a piezoelectric material.

9. The electronic sound source of claim 2 wherein the resilient element is attached to the striking element with an adhesive having a resiliently deformable character when cured.

10. The electronic sound source of claim 9 wherein the transducer means is attached to the resilient element by an adhesive having a resiliently deformable character when cured and is further encapsulated within a coating of said adhesive.

11. An electronic sound source according to claim 1 wherein the attachment means includes fibrous detachable fastener means for removably attaching the striking element to the rim portion of the drum.

12. An electronic sound source for use at a rim portion of a drum, comprising:

a striking element;

attachment means connected to the striking element, for attaching the striking element to the rim portion of the drum and providing an acoustically isolating connection between the striking element and the drum;

a plate removably attached to said striking element;

transducer means, acoustically coupled to the plate, for converting impact induced vibrations in the striking element into an electrical output signal.

13. The electronic sound source of claim 12 further comprising a resilient element interposed between the plate and the transducer means for partially shielding the transducer means from vibrational shock induced in the striking element when the striking element is impacted.

14. The electronic sound source of claim 12 wherein said striking element is a unitary structure having a first and a second portion joined at an approximate right angle in a continuous curve.

15. The electronic sound source of claim 12 wherein said striking element is composed of aluminum.

16. The electronic sound source of claim 12 wherein said striking element is composed of a long chain synthetic polymeric amide.

17. The electronic sound source of claim 12 wherein the striking element has a plurality of holes defined therein and the attachment means comprises a plurality of resiliently deformable grommets respectively disposed in the striking element holes.

18. The electronic sound source of claim 12 wherein the attachment means comprises a plurality of resiliently deformable elements interposed between the striking element and the drum.

19. The electronic sound source of claim 12 wherein said transducer means comprises is a piezoelectric material.

20. The electronic sound source of claim 13 wherein the resilient element is attached to the striking element with an adhesive having a resiliently deformable character when cured.

21. The electronic sound source of claim 20 wherein the transducer means is attached to the resilient element by an adhesive having a resiliently deformable character when cured is and further encapsulated within a coating of the adhesive.

22. An electronic sound source for an electronic drum, comprising:

a unitary structure striking element having a first and second portion joined at an approximate right angle in a continuous curve;

a plurality of resiliently deformable elements interposed between the striking element and the electronic drum;

a resilient element attached to the striking element with an adhesive having a resiliently deformable character when cured; and a piezoelectric transducer bonded to the resilient element with an adhesive having a resiliently deformable character when cured and further encapsulated within the coating of the adhesive.

* * * * *